United States Patent [19]

Dale et al.

[11] 4,382,371

[45] * May 10, 1983

[54] METHOD AND APPARATUS FOR PRODUCING PATTERNING EFFECT ON KNITTED FABRIC

[75] Inventors: David Dale; Robert C. Barksdale, both of Hamilton, Ala.

[73] Assignee: Munsingwear, Inc., Minneapolis, Minn.

[ * ] Notice: The portion of the term of this patent subsequent to Nov. 25, 1997, has been disclaimed.

[21] Appl. No.: 185,191

[22] Filed: Sep. 8, 1980

Related U.S. Application Data

[63] Continuation-in-part of Ser. No. 963,310, Nov. 24, 1978, Pat. No. 4,235,083.

[51] Int. Cl.[3] ..... D04B 27/12

[52] U.S. Cl. ..... 66/213

[58] Field of Search ..... 66/209, 213; 139/25, 139/115

[56] References Cited

U.S. PATENT DOCUMENTS

| | | | |
|---|---|---|---|
| 1,665,274 | 4/1928 | Neisler | 139/25 |
| 3,015,871 | 1/1962 | Noe | 66/210 X |
| 3,036,448 | 5/1962 | Cundiff | 66/213 |
| 3,063,272 | 11/1962 | Bolton | 66/213 |
| 3,072,153 | 1/1963 | Law | 139/25 |
| 3,096,559 | 7/1963 | McNamara | 66/213 X |
| 3,749,136 | 7/1973 | Robinson | 139/109 |
| 3,854,306 | 12/1974 | Heywood et al. | 66/213 |
| 4,069,690 | 1/1978 | Smith | 66/213 |
| 4,235,083 | 11/1980 | Dale et al. | 66/213 |

*Primary Examiner*—Ronald Feldbaum

*Attorney, Agent, or Firm*—Merchant, Gould, Smith, Edell, Welter & Schmidt

[57] ABSTRACT

An attachment for a warp knitting machine is disclosed. The attachment produces a patterned effect on fabric knitted by the warp knitting machine. The warp knitting machine includes at least one warp beam, a thread separating mechanism, a knitting mechanism, and a first tensioning mechanism positioned between the warp beam and the knitting mechanism. The attachment includes a moveable supplemental tensioning mechanism operatively connected to the knitting machine for cyclically varying the tension on first and second groups of threads disposed on opposite sides of the supplemental tensioning mechanism. A mechanism is provided for cyclically moving the supplemental tensioning mechanism in first and second directions about a neutral position to alternately tension the first and second groups of threads.

14 Claims, 12 Drawing Figures

NEUTRAL POSITION
NEUTRAL 20° POSITION
45°

METHOD AND APPARATUS FOR PRODUCING PATTERNING EFFECT ON KNITTED FABRIC

This application is a continuation-in-part of an application filed 24 Nov. 1978, Ser. No. 963,310, of title identical with this application now U.S. Pat. No. 4,235,083.

TECHNICAL FIELD

The present invention relates broadly to knitting of fabrics. More specifically, the present invention relates to an attachment for a warp knitting machine wherein the attachment is used to produce a patterned effect on the fabric knitted by the warp knitting machine. The present invention also relates to the method or process for producing the patterned effect on fabric knitted by a warp knitting machine.

BACKGROUND OF THE INVENTION

The knitting of fabrics on warp knitting machines is known in the prior art. Warp knitting machines generally have one or more warp beams which supply the threads to be knitted. The threads are separated on a sley or thread separator mechanism. The threads thereafter pass over a tensioning bar and pass to a knitting mechanism. The knitting mechanism thereafter knits the individual threads into a knitted fabric wherein each vertical row of stitches is called a wale and each horizontal row of stitches is called a course. One conventional warp knitting machine is produced by the Textile Machine Works of Reading, Pa.

The production of a patterned effect on fabric knitted by a warp knitting machine is also known in the prior art. Prior apparatus and methods of producing such a patterned effect have generally been complex and have necessitated slowing down the operating speed of the knitting machine. The output of the knitting machine is thus reduced.

One type of prior art device for producing a patterned effect on knitted fabrics is known as a "Swan warp attachment". This type of attachment is a complex mechanism which utilizes a plurality of individual droppers or tensioning mechanism to produce the patterned effect.

BRIEF SUMMARY OF THE INVENTION

The present invention relates to an attachment for a warp knitting machine. The attachment produces a patterned effect on fabric knitted by the warp knitting machine. The warp knitting machine has at least one warp beam for supplying threads to be knitted, thread separating means for separating thread supplied from the warp beam, means for knitting the thread supplied from the warp beam, and a first tensioning means positioned between the warp beam and the knitting means for tensioning the threads being supplied to the knitting means. The attachment includes a moveable supplemental tensioning means and a means for cyclically moving the supplemental tensioning means. The supplemental tensioning means is operatively connected to the knitting machine and cyclically varies the tension on first and second groups of threads disposed on opposite sides of the supplemental tensioning means. The moving means moves the supplemental tensioning means in first and second directions about a neutral position whereby the tension on the first group of threads disposed on one side of the supplemental tensioning means increases when the supplemental tensioning means moves in the first direction away from the neutral position and the tension on the second group of threads disposed on the other side of the supplemental tensioning means increases when the supplemental tensioning means moves in the second direction away from the neutral position.

In one embodiment, the supplemental tensioning means includes a single integral tensioning member extending along substantially the entire width of the warp beam, i.e the integral tensioning member should be sufficiently wide to engage all the threads being supplied to the knitting means. The supplemental tensioning member is rotatable through a curved path by means of a linkage mechanism which is connected to a rotatable drive member of the warp knitting machine.

A method in accordance with the present invention is comprised of the steps of disposing a supplemental tensioning member between a warp beam and a tensioning means of a warp knitting machine; passing a first group of threads on one side of the supplemental tensioning member; passing a second group of threads on a second side of the supplemental tensioning member; directing a third group of threads distant from the path of the supplemental tensioning means; and cyclically moving the tensioning member in first and second opposite directions about a neutral position to alternately tension the first and second groups of threads whereby a patterned effect is produced on the fabric knitted by the warp knitting machine.

The present invention instead of using a plurality of complex individual mechanisms utilizes a simple tensioning mechanism and drive mechanism. By utilizing the present invention, the speed at which the warp knitting machine is driven need not be reduced. Thus, a patterned effect on the fabric knitted is produced, without reducing the speed of production as is required in prior art devices.

Various advantages and features of novelty which characterize our invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DETAILED DESCRIPTION OF THE DRAWING

DETAILED DESCRIPTION OF THE INVENTION

Figures 1, 4, 5, 6:
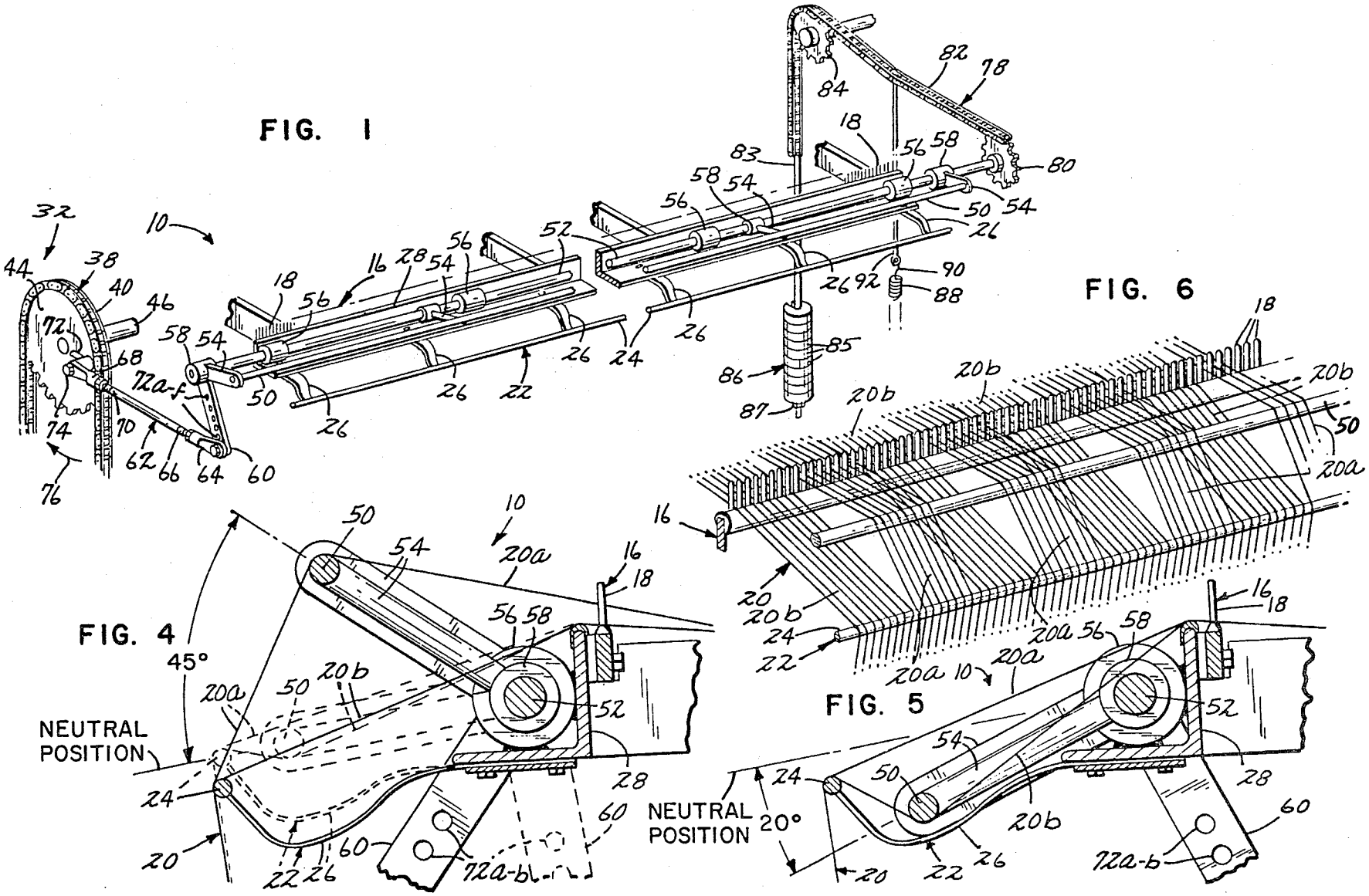
FIG. 1 is a perspective view illustrating an attachment in accordance with a first embodiment of the present invention attached to a warp knitting machine with only several portions of the warp knitting machine illustrated.
FIG. 4 is an enlarged sectional view illustrating a supplemental tensioning member in accordance with the first embodiment in a plurality of positions.
FIG. 5 is a sectional view similar to FIG. 4 illustrating the tensioning member in a lower tensioning position.
FIG. 6 is a fragmentary perspective illustrating threads passing over and under a supplemental tensioning member.
Figure 2:
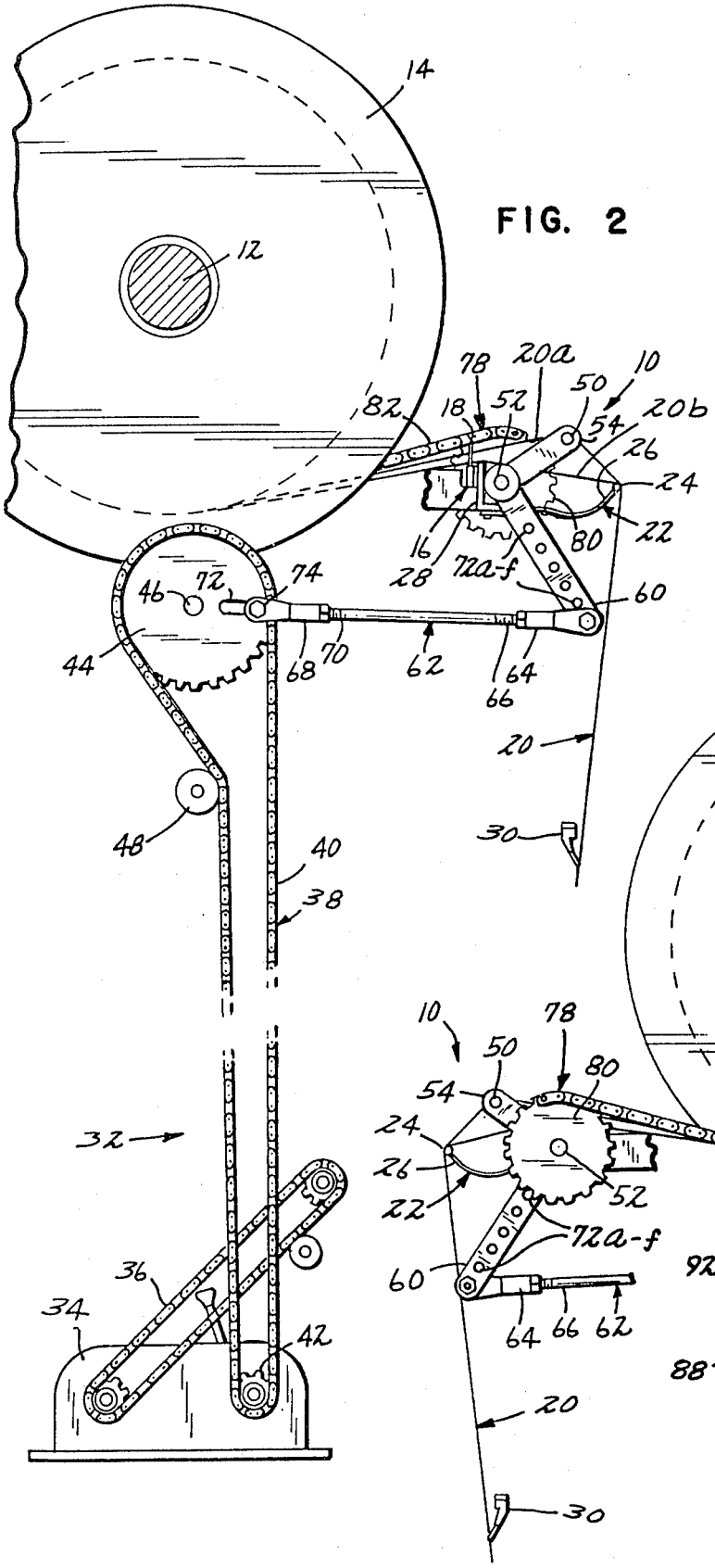
FIG. 2 is a side elevational view of one side of an attachment in accordance with the first embodiment with portions of a warp knitting machine being shown schematically.
Figure 3:
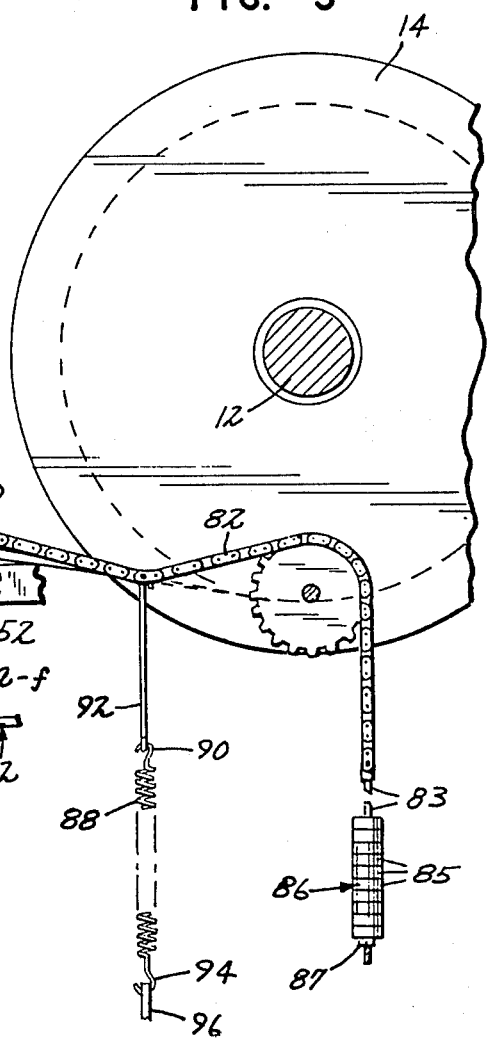
FIG. 3 is a side elevational view of the other side of an attachment in accordance with the first embodiment with portions of the warp knitting machine shown schematically.

Referring to the drawings in detail, wherein like numerals indicate like elements, there is shown in FIG. 1 an attachment in accordance with the present invention designated generally as 10. The attachment 10 is attached to a conventional warp knitting machine. Since the warp knitting machine is of conventional design, only portions of the knitting machine are shown schematically in the Figures. The warp knitting machine includes at least one warp beam 12. Many warp knitting machines utilize two or three warp beams. As seen in FIGS. 2 and 3 a spool 14 is carried upon the warp beam 12. The warp beam 12 may carry one or more spools 14. The spools 14 carry the thread to be knitted by the warp knitting machine.

A conventional warp knitting machine also includes a sley or thread separator 16. The thread separator 16 is comprised of a plurality of spaced prongs or teeth 18 through which threads 20 which are supplied from the spools 14 are passed. The warp knitting machine also includes a first tensioning means, designated generally as 22. The first tensioning means includes a bar or tensioning member 24. The bar 24 is attached at spaced locations along its length to a plurality of spring arms 26. The spring arms 26 in turn are attached to an angled beam or cross brace 28 of the warp knitting machine. The bar or tensioning member 24 extends across substantially the entire width of the warp knitting machine for the purpose of having all the threads 20 pass over it. All the threads 20 may thereby be tensioned prior to being supplied to a knitting mechanism 30 of the warp knitting machine. The warp knitting mechanism 30 can be any conventional warp knitting mechanism and is utilized to knit the threads 20 into a fabric material.

The warp knitting machine also includes a drive mechanism, designated generally as 32. The drive mechanism 32 includes a drive motor 34 which drives the various portions of the warp knitting machine through a plurality of pulley and chain mechanisms 36, 38. The pulley and chain mechanism 38 is shown in some detail in FIGS. 1 and 2. The mechanism 38 includes an endless chain 40 which is received about a first pulley or drive gear 42 and a rotatable member or driven gear 44. The member 44 is attached to a rod 46 and is rotatable about the axis of the rod 46. The endless chain 40 is tensioned by passing over an idler pulley 48. As will be more fully explained hereinafter, the rotatable member 44 provides the motive force for driving the attachment 10.

The attachment 10 includes a supplemental tensioning member or bar 50. The supplemental tensioning member 50 is connected to a rotatable rod 52 through a linkage means comprised of a plurality of linkage arms 54. The rod 52 is rotatably mounted within a plurality of bearing blocks 56. In order to rotatably mount the rod 52 with respect to the warp knitting machine, a majority of the bearing blocks 56 are fixedly attached to the cross brace 28 of the warp knitting machine. The linkage arms 54 are fixably attached to the rod 52 by means of connector members 58 so that the rotary motion of the rod 52 is converted into the motion of tensioning member 50 through a curved path.

In order to rotate the rod 52 and pivot the tensioning member 50 through the curved path, a second linkage arm 60 and a drive arm or rod 62 drivingly couple the rotatable rod 52 to the rotatable member 44 of the warp knitting machine. A first connector member 64 is connected to a first end 66 of the drive arm 62 and a second connector member 68 is connected to a second end 70 of the drive arm 62. The first connector member 64 is pivotably connected to one of a series of holes 72*a–f*. The second connector member 68 is pivotably attached at a fixed location within a slot 72 in the rotatable member 44. The connector member 68 is pivotable about a bolt 74 which couples the connector member 68 to the slot 72.

The rotatable member 44 rotates in a clockwise direction as shown by arrow 76 in FIG. 1. The drive arm 62 is shown in FIGS. 1 and 2 in its most forward disposition wherein the tensioning member 50 is pivoted to its uppermost disposition. The uppermost disposition of the tensioning member 50 is also shown in full line in FIG. 4. As the member 44 continues to rotate in a clockwise direction, the drive arm moves rearwardly and rotates the rod 52 in a clockwise direction to move the rod 50 downwardly through a curved path. The rod 50 passes through a neutral position shown in phantom line in FIG. 4 and continues to pivot downwardly until it reaches its lowermost position shown in FIG. 5. The rod 50 reaches its lowermost position when the drive arm 62 is pulled to approximately its most rearward position. Thereafter, as the member 44 continues to rotate, the drive arm 62 begins to move forwardly and to thereby rotate the rod 52 in a clockwise direction and pivot the tensioning member 50 upwardly through the neutral position until it reaches its uppermost position when the rod 62 is in its forward most position.

As seen in FIG. 6, alternate groups of threads 20*a*, 20*b* are passed over and under the tensioning member 50. The threads 20*a* are passed above the tensioning member 50 and the threads 20*b* are passed under the tensioning member 50. The number of threads in each group 20*a* and 20*b* can be varied according to the desired pattern. Thus, if a broad pattern is desired, the groups 20*a* and 20*b* can be made large for example, one inch or more. If a finer pattern is desired, the groups 20*a* and 20*b* can be made relatively small for example, a quarter of an inch or less. Varying the size of the groups 20*a* and 20*b* varies the size of the pattern and the coarse direction of the fabric.

FIGS. 4 and 5 illustrate the cyclical tensioning effect of the tensioning member 50 upon one of the threads 20*a* and one of the threads 20*b*. The tensioning member 50 is shown in its uppermost position in full line in FIG. 4 wherein the maximum tension is placed upon the threads 20*a*. The neutral position of the tensioning member 50 is shown in phantom line in FIG. 4. In this neutral position, the amount of tension on the threads 20*a* and 20*b* is approximately equal. FIG. 5 illustrates the tensioning member 50 in its lowermost position wherein maximum tension is placed upon the threads 20*b*. The pivoting of the tensioning member 50 between its neutral and uppermost position is through approximately a 45° angular extent, while the pivoting of the tensioning member 50 between the neutral and lowermost position is through approximately a 20° extent. The 20° and 45° angular displacements are required due to the specific constraints placed on the attachment 10 by the warp knitting machine to which it is attached. Hence, when the attachment 10 is attached to various different warp knitting machines, the angular extent between the neutral and uppermost and lowermost positions of the tensioning member 50 may vary.

The amount of movement of the tensioning member 50 between its uppermost and lowermost positions can be adjusted by either singly or in combination varying the pivot point 72*a–f* or varying the position of the second connector member 68 within the slot 72. Such changes vary the effective length of the drive arm 62 acting upon the rotatable rod 52. Since the drive member 44 can be rotated at one speed so that the fabric is knitted at one rate, the pattern effected by the tensioning bar 50 along the wales can be varied by adjusting the effective length of the drive arm 62. That is, while the fabric can be knitted at a single speed, the amount of tensioning, determined by the amount of pivoting of the tensioning member 50, can be varied.

The tensioning member 50 is preferably a single integral rod which extends along the entire width of the warp knitting machine. All of the threads being supplied to the knitting mechanism 30 from the warp beam 12 can thus be cyclically tensioned by the tensioning member 50. In a typical warp knitting machine, the rod 52 would be more than 160 inches long. Torque is transferred to the rod 52 along its entire length due to the tension placed upon the tensioning member 50 by the threads 20*a* and 20*b*. So that the tensioning of the threads 20*a* and 20*b* may be evenly distributed along the entire length of the tensioning member 50, a torque distribution or compensating means, designated generally as 78 is provided at the end of the rod 52 opposite the drive arm 62.

The torque compensating means 78 includes a disc or sprocket 80 fixedly attached to an end of the rod 52 and a segment of chain 82 secured to the disc 80. A second rotatable disc or sprocket 84 supports a portion of the chain 82 intermediate its ends. A second end of the chain 82 has a weight mechanism 86 attached to it. The weight mechanism 86 may include a rod 83 attached to the second end of the chain 82 and a series of weights 85 held on the rod 83 by a nut 87. The number of weights 85 can be adjusted to thereby adjust the amount of tension applied to the chain 82. A damper spring 88 has a first end 90 attached to the chain 82 intermediate the sprockets 80, 84 by means of a rod 92. A second end 94 of the spring 88 is attached to a portion 96 of the warp knitting machine. The torque compensating means 78 provides a dampening and a torque compensating force to the rod 52 so that the tensioning upon the threads 20*a* and 20 *b* is uniform across the entire length of the tensioning member 50. The patterned effect produced on the fabric will thus be even across the entire width of the fabric.

The operation of the apparatus and the method in accordance with the present invention should be evident from the above description and hence, only a short summary will follow. The supplemental tensioning member 50 is disposed between a warp beam 12 and a tensioning means 24 of a warp knitting machine. A first group of threads 20*a* are passed on the one side of the supplemental tensioning member 50 and a second group of threads 20*b* are passed on a second side of the supplemental tensioning member 50. By cyclically moving the tensioning member in first and second opposite directions about the neutral position, tension is alternately applied to the first and second groups of threads 20*a*, 20*b*. The cyclical tensioning on the threads 20*a* and 20*b* cause the knitting mechanism 30 to knit the fabric in a checkerboard type of pattern wherein the tightness of compactness of the knit or weave cyclically varies between a tight and a loose weave. As was mentioned above, the tensioning member 50 is preferably moved in an arcuate path above and below a neutral position.

SECOND EMBODIMENT

The second embodiment of the present invention is shown in FIGS. 7–11 of the drawings. This second embodiment contains many features which are identical to those shown in the first embodiment and have like numerals. The new or different features will have numerals beginning in the hundred series so as to more easily identify them. Where the operation of this embodiment does not differ from the previous embodiment, it will not be reiterated.

Figure 7:
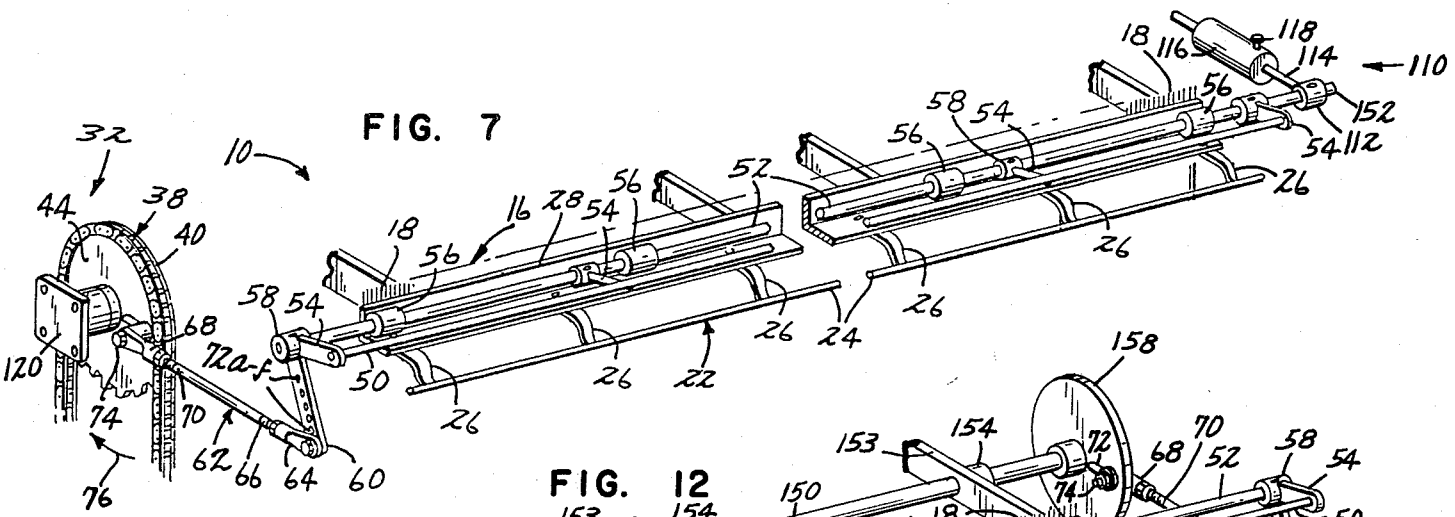
FIG. 7 is a perspective view illustrating an attachment in accordance with a second embodiment of the present invention attached to a warp knitting machine with only several portions of the warp knitting machine illustrated.
Figure 10:
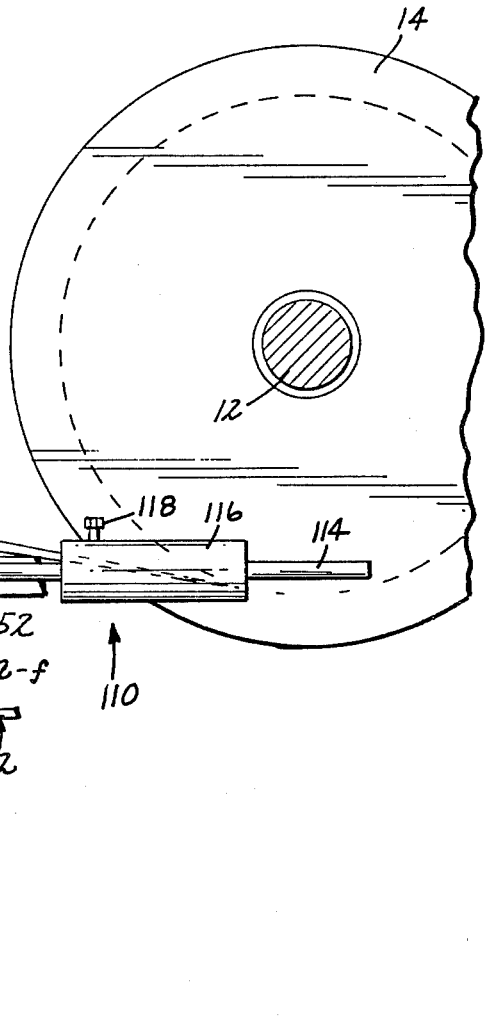
FIG. 10 is a side elevational view of the other side of an attachment in accordance with the second embodiment, with portions of the warp knitting machine shown schematically.

FIGS. 7 and 10 show a portion of the second embodiment primarily with respect to changes in the torque distribution or compensating means. As explained, the torque compensating means 78 in the first embodiment (shown in FIG. 3) was intended to ensure that torque transmitted through tensioning member 50 remained constant throughout the length of this member. Even a slight deviation in torque would show up in the resulting fabric as an unevenness in weave. As an alternative to the torque compensating means of the previous embodiment, this embodiment employs a high tensile steel rod 152. Other materials may be employed so long as they are resistant to twisting. At the far end of rod 152 (i.e., the end opposite the drive mechanism 32), a counterweight system 110 extends perpendicularly from rod 152. The counterweight system includes an attachment ring 112 positioned coaxially with rod 152, a perpendicularly extending member 114, and a slideable weight 116 which includes a boring sized to receive member 114. Weight 116 further includes a set screw 118 for locking weight 116 at a particular point distant from rod 152. It is possible to locate weight 116 and fix it in place by set screw 118 such that torque will be evenly distributed through the length of rod 152, thereby eliminating any distortion in the fabric weave. It is also possible to employ hanging weights in the place of weight 116 so long as they may be adjusted to distribute torque.

It should be noted in FIG. 7 that drive mechanism 32 is attached to a fixed body by means of bearing support 120. The operation of this drive mechanism is otherwise unchanged.

Figure 8:
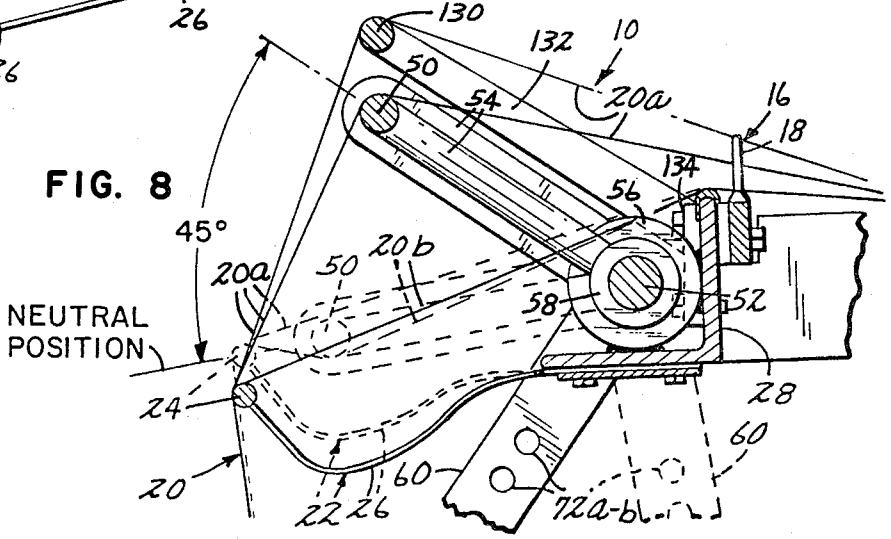
FIG. 8 is an enlarged sectional view illustrating a supplemental tensioning member in accordance with the second embodiment in a plurality of positions.

The first embodiment of the present invention discloses a means for producing a weave having a checkerboard pattern in the case where rod 50 reciprocates above and below the neutral position as shown in FIG. 4. The embodiment as shown in FIG. 8 is capable of producing an alternate pattern as shown schematically in FIG. 11. This pattern shows a section of fabric 122 which has columns of even weave (i.e., normal texture) indicated by arrows 124. In between these columns are periodic cross-hatched sections 126 which indicate portions of looser weave created by the reciprocating action of bar 50. With the addition of override bar 130, which maintains selected threads out of the way of bar 50, shown in FIG. 8, the columns of uniform weave, indicated by arrows 124, are produced. Bar 130 is held distant from attachment 10 by arm 132 which in turn is affixed to cross brace 28 by means of bolts 134. Bar 130 extends for the entire length of attachment 10 and is essentially parallel to bar 50. Bar 130 is located such that it is above bar 50 when that bar is in its uppermost position as shown in FIG. 8. The columns indicated by arrows 124 are produced by carrying selected threads over bar 130 so that they will not be effected by the reciprocating movement of bar 50. It can be seen in FIG. 6 that threads 20*a* are tensioned during the upward stroke of bar 50 and that threads 20*b* are tensioned during the downward stroke of bar 50. By directing some or all of threads 20*a* over bar 130, a uniform pattern will be produced with respect to those threads. If all such threads 20*a* are carried over bar 30, solid columns indicated by 124 will be produced. The width of portions 126 depends on the number of threads which pass under bar 50.

Figure 9:
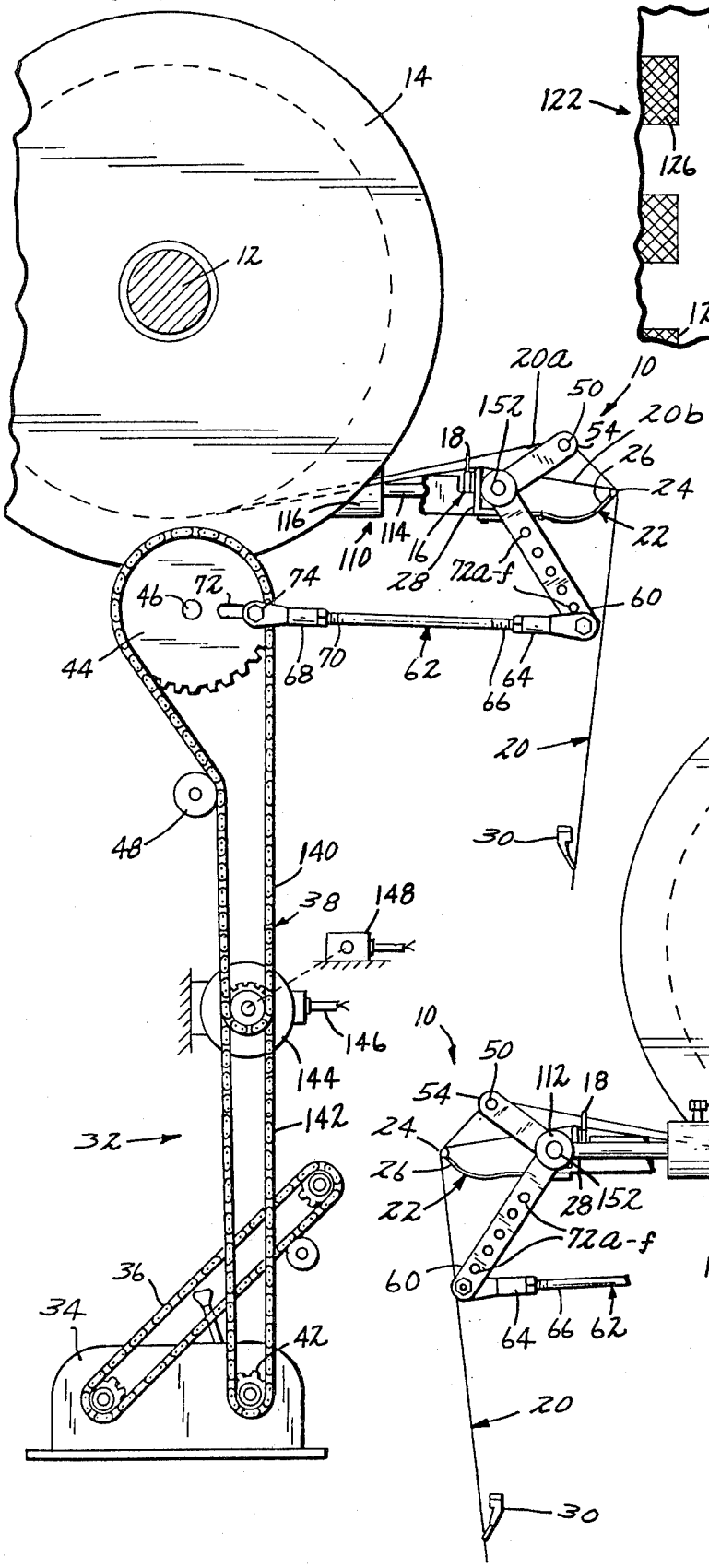
FIG. 9 is a side elevational view of one side of an attachment in accordance with the second embodiment with portions of a warp knitting machine being shown schematically.
Figure 11:
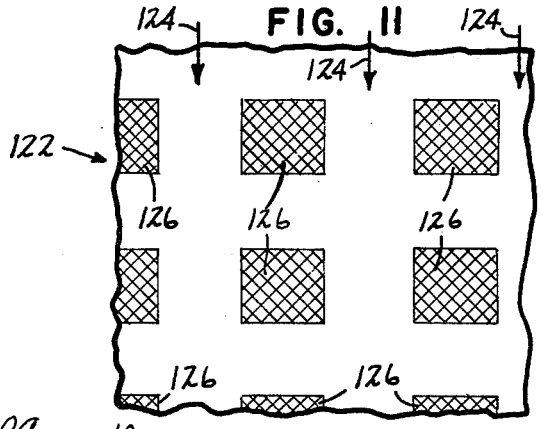
FIG. 11 is a diagrammatic view of a portion of fabric produced by the present invention.

FIG. 9 illustrates an additional feature of this second embodiment. Drive mechanism 32 is altered over the first embodiment such that chain mechanism 38 includes two endless chains 140 and 142 as shown. Both chains rotate at one end around clutch mechanism 144 which may be electrically or mechanically controlled by control box 148 through control line 146. By operating clutch 144, the mechanical drive connection between chains 140 and 142 can be made or broken. By attaching a counting mechanism to the knitting machine, it is possible to switch clutch 144 on and off after any given number of cycles of knitting operations to produce a plaid effect in the material. It is possible to locate a clutch at any point in the power drive system to produce the same effect, i.e., that the attachment 10 can be disconnected at will to produce variant fabric patterns.

THIRD EMBODIMENT

Figure 12:
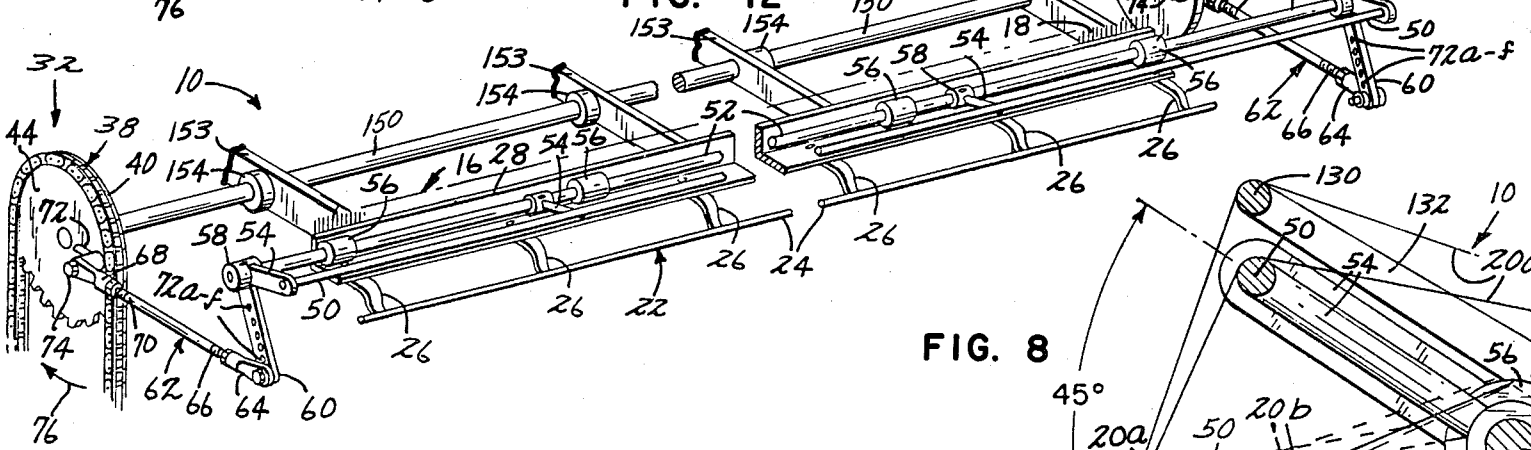
FIG. 12 is a perspective view illustrating an attachment in accordance with a third embodiment of the present invention attached to a warp knitting machine with only several portions of the warp knitting machine illustrated.

A torque compensating or distributing means is shown in a third embodiment in FIG. 12 of the drawing. This embodiment can be generally described as having a mirror image Pittman arm arrangement on both ends of the rod 52 with mechanical power being supplied to both Pittman arm systems. Specifically, rotatable member 44 has a shaft 150 which replaces shaft 46 shown in the first embodiment. Shaft 150 extends through members 153 on bearings 154. At the far end of shaft 150, a disk 158 is attached. In other respects, disk 158 is identical to rotatable member 44, except of course that there is no chain drive. Drive arm 62 and associated members 60–74 are identical, as is the operation of this arrangement. By providing drive through rod 50 to this Pittman arm system, the torque is transmitted to the far end of rod 52 relatively equally so that no distortion appears in the weave of the fabric.

Numerous characteristics and advantages of our invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. An attachment for a warp knitting machine for producing a patterned effect on fabric knitted by the warp knitting machine, the warp knitting machine having at least one warp beam for supplying threads to be knitted, thread separating means for separating threads supplied from said warp beam, means for knitting the threads supplied from said warp beam, and first tensioning means positioned between said warp beam and said knitting means for tensioning the threads being supplied to said knitting means, said attachment comprising:

movable supplemental tensioning means operatively connected to said knitting machine for cyclically varying the tension on first and second groups of threads disposed on opposite sides of said supplemental tensioning means, said supplemental tensioning means including a single tensioning member disposed between the warp beam and the first tensioning means and having a sufficient length for tensioning all of the threads being supplied from said warp beam; and means for cyclically moving said supplemental tensioning means in first and second opposite directions about a neutral position whereby the tension on the first group of threads disposed on one side of the supplemental tensioning means increases when the supplemental tensioning means moves in the first direction away from the neutral position and the tension on the second group of threads disposed on the other side of the supplemental tensioning means increases when the supplemental tensioning means moves in the second direction away from the neutral position, said moving means including a rotatable rod, first linkage means connecting said rod to said tensioning member, means for rotating said rod including a second linkage means attached to said rotatable rod adjacent a first end thereof and a drive arm connecting said second linkage means attached to a drive member of the knitting machine, and torque compensating means for equalizing torque applied to said rotatable rod along its length including means for biasing said rotatable rod in a rotational direction, said biasing means being coupled to a second end of said rotatable rod opposite said first end of said rotatable rod, said biasing means including a counterweight system movably attached to said second end of said rotatable rod and distant therefrom, whereby the patterned effect produced on the fabric will be even across the width of the fabric.

2. An attachment according to claim 1 wherein said counterweight system includes a first rod extending generally perpendicularly from said rotatable rod, a counterweight slideably connected to said first rod so that said counterweight may be located at a point distant from said rotatable rod equalizing torque along the length of said rotatable rod.

3. An attachment according to claim 1 wherein said rotatable rod is made of tortion resistant material.

4. An attachment for a warp knitting machine for producing a patterned effect on fabric knitted by the warp knitting machine, the warp knitting machine having at least one warp beam for supplying thread to be knitted, thread separating means for separating the threads supplied from said warp beam, means for knitting the threads supplied from said warp beam, and tensioning means positioned between said warp beam and said knitting means for tensioning the threads being supplied to said knitting means, said attachment comprising:

supplemental tensioning means for cyclically varying the tension on groups of threads disposed on opposite sides of said supplemental tensioning means;

said supplemental tensioning means including a single tensioning member disposed between the warp beam and the first tensioning means and having a sufficient length for tensioning all of the threads being supplied from said warp beam;

means for cyclically moving said supplemental tensioning member through a curved path in first and second opposite directions about a neutral position;

said moving means including a rotatable rod having a first and a second end, a first linkage means connected between said rod and said supplemental tensioning member to convert the rotary motion of said rod to the pivotable motion of said supplemental tensioning member, a second linkage means connected to said rod and a drive arm having a first end pivotably connected to said second linkage means and a second end adapted to be connected to a rotatable member of the warp knitting machine whereby the rotation of said rotatable member is transferred into the curved motion of said supplemental tensioning member by means of said drive arm, said first and second linkage means and said rotatable rod, said second linkage means being coupled to the first and second ends of said rotatable rod, and torque compensating means for equalizing torque applied to said rotatable rod along its length, said torque compensating means including a disk fixedly secured to the second end of said rotatable rod, a transmission rod connecting said rotatable member to said disk, a second drive arm pivotally connected to said disk at one end and said second linkage means at the other end so that rotational force is applied to both ends of said rotatable rod thereby equalizing torque transmitted therethrough.

5. An attachment for a warp knitting machine for producing a patterned effect on fabric knitted by the warp knitting machine, the warp knitting machine having at least one warp beam for supplying threads to be knitted, thread separating means for separating threads supplied from said warp beam, means for knitting the threads supplied from said warp beam, and first tensioning means positioned between said warp beam and said knitting means for tensioning the threads being supplied to said knitting means, said attachment comprising:

movable supplemental tensioning means operatively connected to said knitting machine for cyclically varying the tension on first and second groups of threads disposed on opposite sides of said supplemental tensioning means, said supplemental tensioning means including a single tensioning member disposed between the warp beam and the first tensioning means and having a sufficient length for tensioning all of the threads being supplied from said warp beam; and means for cyclically moving said supplemental tensioning means in first and second opposite directions about a neutral position whereby the tension on the first group of threads disposed on one side of the supplemental tensioning means increases when the supplemental tensioning means moves in the first direction away from the neutral position and the tension on the second group of threads disposed on the other side of the supplemental tensioning means increases when the supplemental tensioning means moves in the second direction away from the neutral position, said moving means including a rotatable rod, first linkage means connecting said rod to said tensioning member, means for rotating said rod including a second linkage means attached to said rotatable rod adjacent a first end thereof and a drive arm connecting said second linkage means attached to a drive member of the knitting machine, and torque compensating means for equalizing torque applied to said rotatable rod along its length; and means for maintaining selected threads distant from said supplemental tensioning means so that said selected threads will not be tensioned, thereby producing a patterned effect in the fabric of intermittently tensioned weave in a side-by-side relationship with a uniformly tension weave of selected threads.

6. A method for producing a patterned effect on a fabric being knitted by a warp knitting machine, the warp knitting machine having at least one warp beam for supplying threads to be knitted, thread separating means for separating threads supplied from said warp beam, means for knitting the threads supplied from said warp beam into a fabric, and tensioning means positioned between said warp beam and said knitting means for tensioning the threads being supplied to said knitting means, said method comprising the steps of:

(a) disposing a supplemental tensioning member between said warp beam and the tensioning means;

(b) passing a first group of threads on one side of the supplemental tensioning member;

(c) passing a second group of threads on a second side of the supplemental tensioning member;

(d) directing a third group of threads distant from the path of the supplemental tensioning means;

(e) cyclically moving the supplemental tensioning member in first and second opposite directions about a neutral position to alternately tension said first and second groups of threads which said knitting means is knitting said threads into fabric, whereby a patterned effect is produced on the fabric knitted by the knitting means.

7. A method in accordance with claim 6 wherein step (d) includes pivoting said supplemental tensioning member in an arcuate path about said neutral position.

8. A method in accordance with claim 6 wherein step (a) includes disposing said supplemental tensioning member above said tensioning means and step (e) includes cyclically pivoting the tensioning member upwardly through an arcuate path of a first length and downwardly through an arcuate path of a second length.

9. A method in accordance with claim 6 wherein steps (b), (d), and (e) include selecting the width of said first and second groups of threads to correspond to the width of a pattern to be produced and by selecting the widht of said third groups of threads to correspond to the width of columns of uniform weave to be produced.

10. A method in accordance with claim 6 including the step (e) of adjusting the amount of movement of said supplemental tensioning member in said first and second directions to correspond to the length of the pattern to be produced.

11. An attachment according to claim 4 or 5 including clutch means interposed between said attachment and the knitting machine for intermittently connecting a disconnected power from said attachment whereby a patter effect can be intermittently produced on the fabric.

12. An attachment according the claim 11 further including means for counting cyclical movement of said supplemental tensioning means and for intermittently operating said clutch means according for a predetermined number of cycles to produced an intermittent patterned effect in the fabric.

13. An attachment according to claim 1 or 4 including means for maintaining selected threads distant from said supplemental tensioning means so that said selected threads will not be tensioned thereby producing a pattern of intermittent tensioned weave in a side-by-side relationship with a uniformly weave.

14. An attachment according to claim 13 wherein said maintaining means includes a member positioned generally parallel with and generally above said supplemental tensioning means for carrying selected threads out of the cyclical path of tensioning means thereby avoiding the tensioning action thereof.

* * * * *